United States Patent [19]

Hull et al.

[11] Patent Number: 4,951,337

[45] Date of Patent: Aug. 28, 1990

[54] MECHANIC'S SUPPORT PILLOW

[76] Inventors: Harold L. Hull, 401 Canyon Way, Sp. 43, Sparks, Nev. 89431; Roger Clark, P.O. Box 518, Portola, Calif. 96122

[21] Appl. No.: 182,126

[22] Filed: Apr. 15, 1988

[51] Int. Cl.[5] ..... A42B 1/00; A42B 1/24; A47G 9/00

[52] U.S. Cl. ..... 5/434; 2/199

[58] Field of Search ..... 5/434, 435, 436, 437; 297/393; 2/185 R, 199, 171, 422, 209.1, 196, DIG. 11

[56] References Cited

U.S. PATENT DOCUMENTS

| | | | |
|---|---|---|---|
| 1,434,854 | 11/1922 | Stall | 2/171 |
| 1,491,146 | 4/1924 | Larson | 5/434 |
| 1,713,049 | 5/1929 | Millson | 2/199 |
| 1,726,270 | 8/1929 | Kantrowitz | 2/199 |
| 3,008,464 | 11/1961 | Atkins | 297/393 |
| 4,698,852 | 10/1987 | Romero | 2/171 |

FOREIGN PATENT DOCUMENTS

| | | | |
|---|---|---|---|
| 390706 | 8/1908 | France | 2/199 |
| 462984 | 4/1951 | Italy | 2/171 |

*Primary Examiner*—Alexander Grosz

[57] ABSTRACT

A pillow designed and adapted to cover the back portion of a user's head such as a mechanic or workman, said pillow being secured to user's head by means of an elastic or adjustable strap thereby freeing up the use of both of the user's hands when the user is moving about on his back beneath a vehicle or the like, with the filling of the pillow being removable to facilitate the cleaning or washing of the pillow cover and strap, and with the section of the pillow which lays adjacent to the user's head containing means to attach a cap to cover the user's head which cap may also be provided with a visor or the like to protect the eyes of the user.

4 Claims, 1 Drawing Sheet

MECHANIC'S SUPPORT PILLOW

BACKGROUND OF THE INVENTION

1. Field of the Invention

This invention relates to head support pillows and the like which are used by workmen such as mechanics when working in a position in which they must lay on their back underneath equipment or the like.

2. Description of the Prior Art

For years mechanics and other workmen, when lying beneath equipment, have had to rely on a make shift pillow beneath their head which must be continually moved about to various locations as the mechanic or workman shifts his body beneath the equipment to generally work on engines or other parts or equipment and most of the time both his hands are being utilized in performing work with tools, parts and the like. When it becomes necessary to reposition his body, he must disengage one hand or the other in order to reposition the pillow which causes delays and inconvenience, many times having to put down a tool or part which he is using and then find the tool or part again after repositioning himself, all the time lying on his back or side in such a position as to make it difficult to see where he has laid the tool or parts being used.

In the past this problem has been addressed by using a device known in the trade as a "creeper," which is a small cart with low swivel casters, and most creepers contain a head rest which in general is hard and uncomfortable, and the creeper can only be used in ideal circumstances such as in a garage or the like which has a smooth, hard floor for the casters to roll on. Also the creeper is expensive as it is generally made of hardwood and has a leather covered head rest or the like which cannot be removed or replaced when it gets soiled from grease, dirt and perspiration and the like and the creeper is also a bulky device which is not generally carried in the vehicle but is kept in a garage or the like.

The purpose of this invention is to provide an economical pillow device which supports the head of the user and is designed to be comfortable in that the core is made of pliable material such as foam rubber and is contoured to fit and support the head in such a manner as to relax the user and prevent neck cramps and the like.

A further purpose is to provide means to secure the pillow to the head of the user by means of an adjustable strap or an elastic band or the like which causes the pillow to move with the head of the user as the user moves about beneath the vehicle.

Still another purpose is to allow the user the freedom of both hands as it is now not necessary to move or adjust the pillow as it is attached to his head.

It is a further purpose to provide a simple, portable, light weight devise that may be carried in the vehicle for use in emergency situations.

A further purpose is to provide a head rest which may be used on any surface such as soft ground, gravel, roadways, etc.

Still another purpose is to provide a pillow which may be easily cleaned and kept in a sanitary condition.

Another purpose is to provide a pillow which is attachable to the back of, or is part of, a user's cap or the like which also keeps his head and hair from being soiled from grease, oil, dirt and debris and the like.

Still another purpose is to provide a visor or the like on the cap which will keep grease, oil and debris and the like from falling in the user's eyes.

Other advantages and meritorious features of the present invention will be more fully understood from the following description of the drawings and the preferred embodiments, the claims, and the detailed drawings which are described hereinbelow.

DETAILED DESCRIPTION OF THE DRAWINGS

Figure 6:
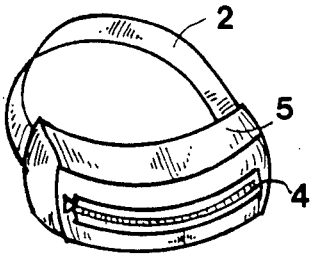
FIG. 6 is a rear perspective view of the pillow case or cover.
Figure 1:
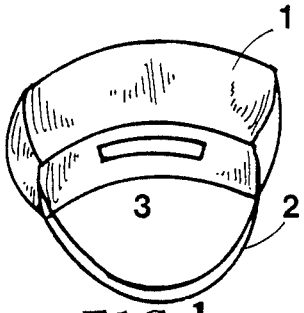
FIG. 1 is a perspective view of the pillow with an attaching strap.
Figure 7:
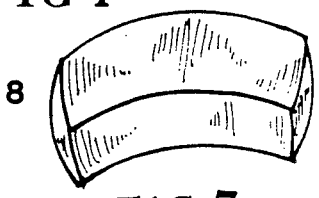
FIG. 7 is a perspective view of the pillow core.
Figure 2:
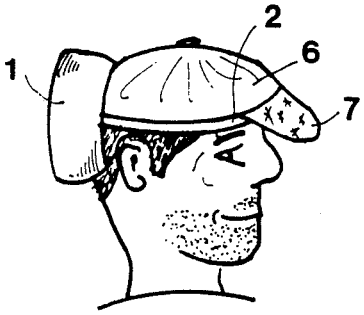
FIG. 2 is a side view of a user wearing the pillow.
Figure 3:
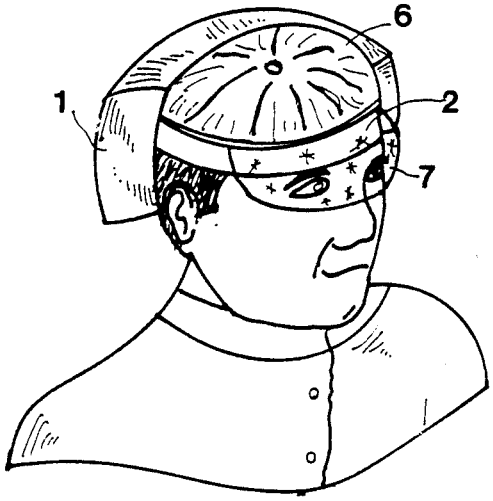
FIG. 3 is a perspective view of a user wearing the pillow which is attached to a cap with a visor.

1 is an assembled pillow, 2 is a head band or strap while 3 is a closeable flap to attach pillow to cap 6, 4 being a zipper, 5 being a pillow cover or the like, while 7 is a visor with 8 being the core or body of the pillow, and 9 is the strap of a cap, with 10 being a hook and loop type fastener or the like.

Figure 5:
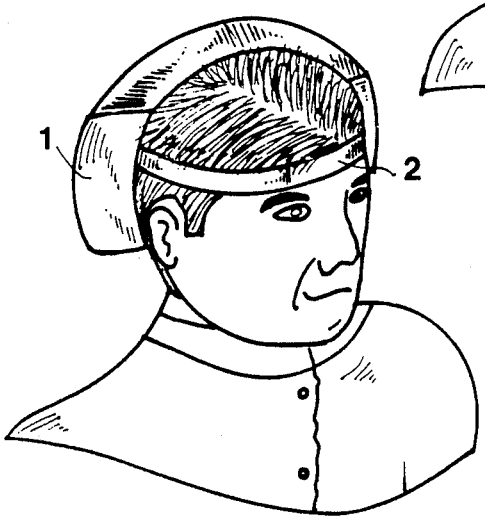
FIG. 5 is a perspective view of a user wearing the pillow.
Figure 4:
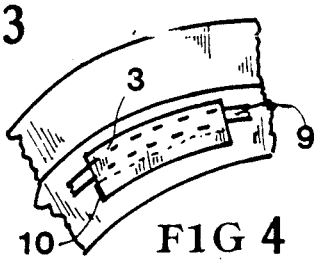
FIG. 4 is a detail of means to fasten pillow to a cap.

Now it can readily be seen that when the core or body of the pillow 8 is inserted into the zippered pillow cover 5 and zippered or fastened in a closed position, and that when head band 2 (being made of an elastic material and/or adjustable strap which is fastened by a buckle or a hook and loop type fastener, such as the ones sold under the trademark of Velcro or the like,) is placed over the head of the user, that the pillow 1 is now held firmly to the back of the head of the user as shown in FIG. 5, providing a comfortable support for the head of the user while at the same time giving him mobility to move about without using his hands to move or adjust the pillow.

It will also be seen that the user can now work on any type of surface such as grass, gravel, soft ground or roadway or the like, and by attaching the cap 6 to the pillow 1 by means of the closeable flap 3 which closes over strap 9 of the cap 6 thereby holding together the cap 6 and the pillow 1 along with the visor 7, that the head of the user will be kept clean from being soiled from grease, oil, drippings or falling debris or the like and that his eyes will also be protected.

It will also be obvious that when the pillow cover 5 becomes soiled, it can readily be removed from the core or body of the pillow 8 and cleaned along with the head band or strap 2 so that the device may be maintained in a clean and sanitary condition.

It will also be noted that this device can be manufactured economically as there are no complicated parts such as casters or the like and that the devise being simple, portable and lightweight, may easily be carried in any vehicle for use in an emergency.

Having described our invention, what we claim as new and desire to secure by Letters Patent is:

1. In combination with a cap that has a strap in its back portion, a mechanic's support pillow comprising;

(a) an elongated segment with a substantially homogeneous filling forming a pillow of generally rectangular shape sufficient to cover the back portion and a substantial portion of each side of the head of a user and being of a general constant thickness to not merely cushion the head but to support the head and neck of the user in a horizontal position on a plane substantially parallel with the torso when lying in a supine position;

(b) strap means connected between the end portions of the support pillow, adapted to secure the pillow to the head of a user; and (c) a flap portion located on the inside portion of the pillow, in the area that contacts the back portion of the head of the user, a lower edge of said flap being adapted to be releasably attached to the pillow to thereby releasably engage the strap portion of the cap.

2. The combination of claim 1, in which the elongated segment contains a zipper, permitting the removal and replacement of the homogeneous filling.

3. The combination of claim 1, in which the lower edge of the flap is releasably attached to the pillow by a hook and loop type fastening strip.

4. The combination of claim 1, in which the cap comprises a see-through visor.

* * * * *